US008685498B2

(12) United States Patent
Miyata et al.

(10) Patent No.: US 8,685,498 B2
(45) Date of Patent: Apr. 1, 2014

(54) COATED FILM FORMING METHOD

(75) Inventors: Takahiro Miyata, Chigasaki (JP); Masao Murata, Chigasaki (JP); Mitsuru Yahagi, Chigasaki (JP); Junpei Yuyama, Chigasaki (JP); Kyuzo Nakamura, Chigasaki (JP); Atsushi Kira, Chigasaki (JP); Kou Fuwa, Chigasaki (JP); Ai Tanaka, Chigasaki (JP); Tooru Okuno, Chigasaki (JP); Susumu Sakio, Chigasaki (JP)

(73) Assignee: Ulvac, Inc., Chigasaki-shi (JP)

( * ) Notice: Subject to any disclaimer, the term of this patent is extended or adjusted under 35 U.S.C. 154(b) by 1111 days.

(21) Appl. No.: 12/641,721

(22) Filed: Dec. 18, 2009

(65) Prior Publication Data

US 2010/0112230 A1 May 6, 2010

Related U.S. Application Data

(63) Continuation of application No. PCT/JP2008/061015, filed on Jun. 17, 2008.

(30) Foreign Application Priority Data

Jun. 29, 2007 (JP) ..... 2007-172309

(51) Int. Cl.
*B05D 1/02* (2006.01)

(52) U.S. Cl.
USPC ..... 427/421.1; 427/427.2; 427/427.3; 427/256; 427/264; 427/265; 427/284; 427/285; 427/287; 427/288

(58) Field of Classification Search
USPC ..... 427/421.1, 427.3, 256, 264, 265, 284, 427/285, 287, 288, 427.2
See application file for complete search history.

(56) References Cited

FOREIGN PATENT DOCUMENTS

| | | | |
|---|---|---|---|
| JP | 06-255098 | | 9/1994 |
| JP | 10-250118 | | 9/1998 |
| JP | 11-138784 | | 5/1999 |
| JP | 2005-040653 | * | 2/2005 |
| JP | 2005-40653 A1 | | 2/2005 |
| JP | 2005-254210 | * | 9/2005 |
| JP | 2005-254210 A1 | | 9/2005 |
| JP | 2006-341216 A1 | | 12/2006 |

(Continued)

OTHER PUBLICATIONS

International Search Report for International Application PCT/JP2008/061015 dated Sep. 18, 2008.

(Continued)

*Primary Examiner* — Timothy Meeks
*Assistant Examiner* — Nathan T Leong
(74) *Attorney, Agent, or Firm* — Kratz, Quintos & Hanson, LLP

(57) ABSTRACT

A coated film with no observable streak is formed. The landing positions of a first discharge liquid discharged through a first printing head and the landing positions of a second discharge liquid discharged through a second printing head are disposed in a mixed manner in an area on a substrate where the first printing head and the second printing head overlap. Which discharge liquids are to be landed is determined according to random numbers. Since a coated film which is formed with the first and second discharge liquids in a mixed manner is disposed between a coated film formed with the first discharge liquids and a coated film formed with the second discharge liquids, a boundary is obscured and no streak appears.

7 Claims, 7 Drawing Sheets

(56) References Cited

FOREIGN PATENT DOCUMENTS

| | | |
|---|---|---|
| JP | 2006-343618 | 12/2006 |
| JP | 2006-343618 A1 | 12/2006 |
| JP | 2008-170844 | 7/2008 |
| JP | 2008-170844 A1 | 7/2008 |

OTHER PUBLICATIONS

Japanese Office Action issued Jan. 8, 2013 in counterpart application No. 2009-521570 with English translation (6 pages).

* cited by examiner

COATED FILM FORMING METHOD

This application is a continuation of International Application No. PCT/JP2008/061015, filed on Jun. 17, 2008, which claims priority to Japan Patent Application No. 2007-172309, filed on Jun. 29, 2007. The contents of the prior applications are herein incorporated by reference in their entireties.

BACKGROUND OF THE INVENTION

1. Field of the Invention

The present invention generally relates to a technical field of forming a coated film by landing a discharge liquid discharged through nozzles on a surface of a substrate.

2. Description of the Background Art

A technique using a printer of an ink jet is commonly used to form a coated film on a surface of a substrate.

For example, in FIG. 6, a reference numeral 101 denotes a printer, and a movable arm 112 having a plurality of printing heads 120 is disposed on a table 111.

Each of the printing heads 120 has a plurality of discharge holes 125 (FIG. 7). Piezoelectric elements are disposed inside the printing heads 120. The discharge liquid is discharged through each of the discharge holes 125 by controlling a voltage applied to the piezoelectric elements while the discharge liquid is being fed to the printing head 120 from a tank 116.

A substrate 107 is placed on the table 111. When the discharge liquid is discharged through each printing head 120 while the movable arm 112 is moving, the discharge liquid lands on the surface of the substrate 107 to form a coated film 130 of the discharge liquid. A thin film forms by drying or thermally curing the coated film 130 of the discharge liquid.

Since there are unavailable areas 128 in which discharge holes 125 cannot be formed in both end portions of each of the printing heads 120, in order to dispose the discharge holes 125 consecutively at an equal interval in an identical direction, two adjacent printing heads 120 are disposed forward and rearward of their moving direction so that their end portions are overlapped. Thus, the discharge holes 125 of one printing head 120 disposed rearward in the moving direction pass through a portion of the surface of the substrate 107 where the unavailable area 128 of the other printing head 120, which is disposed forward of the moving direction, passes through.

Further, in order to ensure the overlapping therebetween, a plurality of discharge holes 125 near the end portion of the front printing head 120 and a plurality of the discharge holes 125 near the end portion of the rear printing head 120 are to move along the same pathway and pass above the same position of the substrate.

In order to ensure that the thickness of a coated film 130 formed on the portion through which the overlapped printing heads 120 pass may be equal to the thickness of the coated film formed on a portion through which the discharge holes 125 of one of the front or the rear printing heads 120 passes, and also so that there would not be a portion of the substrate 107 on which no discharge liquid lands, the discharge liquid is discharged only through the discharge holes 125 of either one of the printing heads 120 in the portion where the overlapped discharge holes 125 pass.

In this case, even when the discharge liquids discharged through the respective printing heads 120 land at regular intervals so that the coated film 130 formed with the discharge liquids discharged through the discharge holes 125 of the front printing head 120 may be placed in contact with and adjacent to the coated film 130 formed with the discharge liquids discharged through the discharge holes 125 of the rear printing head 120, there is a problem that there is a possibility that a streak 139 may appear at a portion in which the coated films 130 of the different printing heads 120 are adjacent to each other.

See Japanese Patent Document JP-A 11-138784.

SUMMARY OF THE INVENTION

The inventors of the present invention investigated the cause of the problem, and they found that the above-explained phenomenon is caused by the fact that, even if the voltage to be applied to each of the printing heads is controlled in order to set the amounts of the discharge liquid discharged from the plurality of printing heads to be uniform, the discharge amounts differ in minute scales, depending upon the respective printing heads.

Therefore, a coated film which is formed with the discharge liquid in an amount intermediate between the amount of the discharge liquid from one discharge hole of the front printing head and the amount of the discharge liquid from one discharge hole of the rear printing head has to be simply disposed between the coated film formed with the discharge liquid of the front printing head and the coated film formed with the discharge liquid of the rear printing head to solve the above problem. However, since a difference in the amount of the discharge liquid discharged by the front and rear printing heads is very small, it is difficult to adjust the amount of the discharge liquid released to be intermediate between the two amounts.

The inventors of the present invention discovered that only the average value of the amounts of the discharge liquids has to be made intermediate between the amounts of a first and a second discharge liquids in an overlapped area between a first and a second printing heads to reduce the appearance of the streaks, and arrived at solving the above problem.

That is, in order to solve the above-mentioned problem, an embodiment of the present invention is directed to a method for forming a coated film on a surface of a substrate by making a first discharge liquid or a second discharge liquid land on predetermined landing positions on the surface of the substrate, the first and second discharge liquid being discharged from a first and second discharge holes by performing a relative movement between the substrate and a first and second printing heads having a plurality of the first and second discharge holes which are disposed along an identical direction, the method including the steps of: disposing the first and second printing heads front and rear in a direction of the relative movement such that the second discharge hole positioned in an end portion of the second printing head moves on a moving path of at least one first discharge hole positioned in an end portion of the first printing head, as well as directing the direction in which the first and second discharge holes disposed to a direction which crosses the direction of the relative movement; and making the first or the second discharge liquid land on the landing positions, by performing the relative movement, on moving paths through which only either one of the first or the second discharge holes passes, such that the landing positions on which the first discharge liquids land and the landing positions on which the second discharge liquids land are present in a mixed manner, on the landing positions in the moving path through which both the first and second discharge holes pass, at least in one row in a direction vertical to the moving path.

The present embodiment may also be directed to a method for forming coated film, further including the step of: disposing the landing positions on which the first discharge liquids land and the landing positions on which the second discharge liquids land such that they are mixed together also in one row that is parallel to the direction of the relative movement.

An embodiment of the present invention may be directed to a method for forming a coated film on a surface of a substrate by making a first discharge liquid or a second discharge liquid land on predetermined landing positions on the surface of the substrate, the first and second discharge liquid being discharged from a first and second discharge holes by performing a relative movement between the substrate and a first and second printing heads having a plurality of the first and second discharge holes which are disposed along an identical direction, the method including the steps of: disposing the first and second printing heads front and rear in a direction of the relative movement such that the second discharge hole positioned in an end portion of the second printing head moves on a moving path of at least one first discharge hole positioned in an end portion of the first printing head, as well as directing the direction in which the first and second discharge holes disposed to a direction which crosses the direction of the relative movement; and making the first or the second discharge liquid land on the landing positions, by performing the relative movement, on moving paths through which only either one of the first or the second discharge holes passes, such that the landing positions on which the first discharge liquids land and the landing positions on which the second discharge liquids land are present in a mixed manner, on the landing positions in the moving path through which both the first and second discharge holes pass, at least in one row parallel to the moving path.

The present embodiment may be directed to a method for forming coated film, further comprising the step of: setting the first and second discharge liquids not to land on top of each other, both on the same landing positions.

An embodiment may be directed to a method for forming coated film, wherein a third film thickness of a third coated film formed in the moving path where both of the first and second discharge holes pass is formed to be intermediate-sized between a first film thickness of a first coated film formed in an area through which only the first discharge holes pass and a second film thickness of a second coated film formed in an area through which only the second discharge holes pass.

An embodiment may be directed to a method for forming coated film, further including the step of: selecting one condition, from landing conditions including at least a first condition where only the first discharge liquid lands and a second condition where only the second discharge liquid lands, on landing positions located between the areas where the coated films having the first and second film thicknesses are formed, with respect to each landing position according to random numbers, in order to perform landing according to the selected condition.

An embodiment may be directed to a method for forming coated film, further including the step of: memorizing the selected condition with respect to each of the landing position, in order to perform landing under the same condition on the same landing position of a different substrate.

An embodiment may be directed to a method for forming coated film as described in any of the above, further including the step of: selecting the landing positions on which the first discharge liquids land and the landing positions on which the second discharge liquids land, according to the random numbers, in order to be present in a mixed manner.

An embodiment may be directed to a method for forming coated film, further including the step of: selecting the landing positions on which the first discharge liquids land and the landing positions on which the second discharge liquids land, according to random numbers, also in a direction in parallel to the direction of the relative movement.

An embodiment may be directed to a method for forming coated film as set forth in any of the above, further including the step of: selecting the landing positions on which the first discharge liquids land and the landing positions on which the second discharge liquids land, according to random numbers, in order to be present in a mixed manner.

According to an embodiment of the present invention, which is constructed as explained above, in the area where the overlapped first and second discharge holes move on the same moving path, the landing positions on which the first discharge liquids are to be landed and the landing positions on which the second discharge liquids are to be landed are made as discontinuous as possible, and the former landing positions and the latter landing positions are mixed but without a constant cycle.

No streak is formed in a direction along the moving direction of the printing head.

In addition, no streak is formed in a direction vertical to the direction along the moving direction of the printing heads, either.

BRIEF DESCRIPTION OF THE DRAWINGS

FIG. 1 (*b*) is a schematic diagram illustrating a plan view of the printer to be used in an embodiment.

DETAILED DESCRIPTION OF THE INVENTION

Figure 1A:
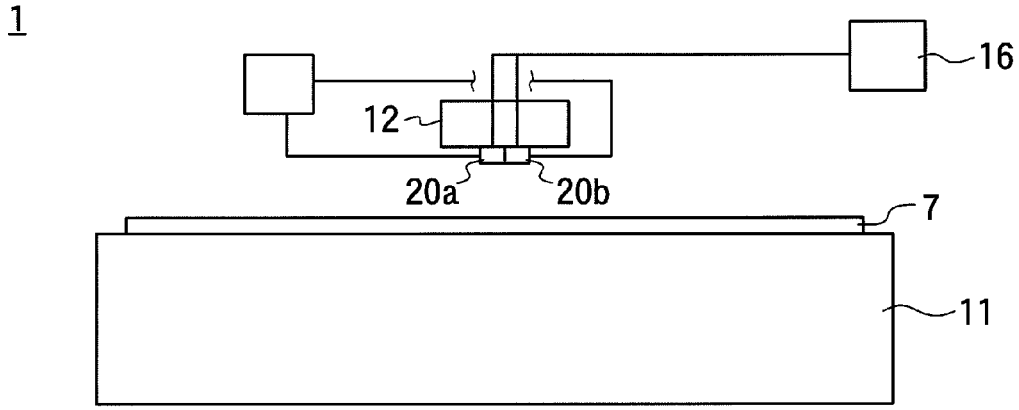
FIG. 1 (*a*) is a schematic diagram illustrating a side view of a printer to be used in an embodiment of the present invention.
Figure 1B:
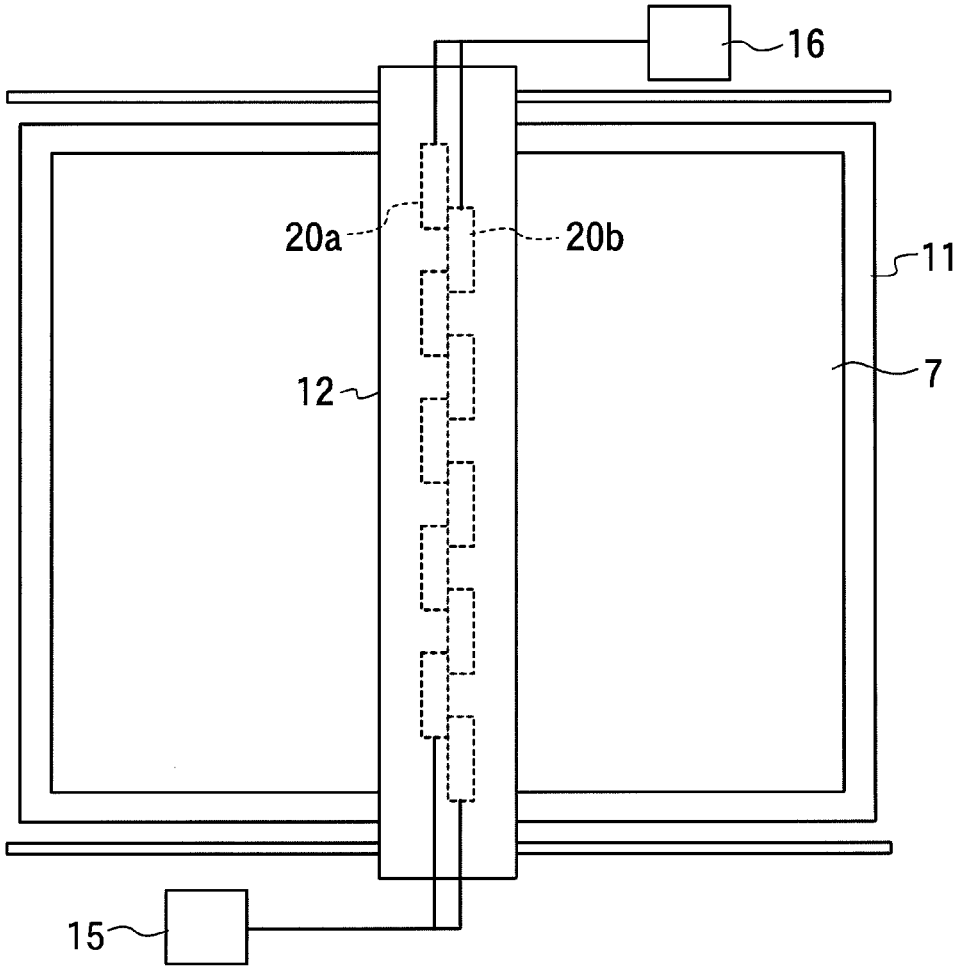

In FIGS. 1 (*a*) and (*b*), a reference numeral 1 shows a printer to be used in an embodiment of the present invention.

The printer 1 has a table 11, and a movable arm 12 is disposed above the table 11. A plurality of printing heads 20*a*, 20*b* are disposed at a portion of the movable arm 12 which faces the table 11. In this embodiment, two adjacent printing heads 20*a*, 20*b* among the plurality of printing heads 20*a*, 20*b* will be referred to as a first and a second printing heads for explanatory purposes.

Figure 2:
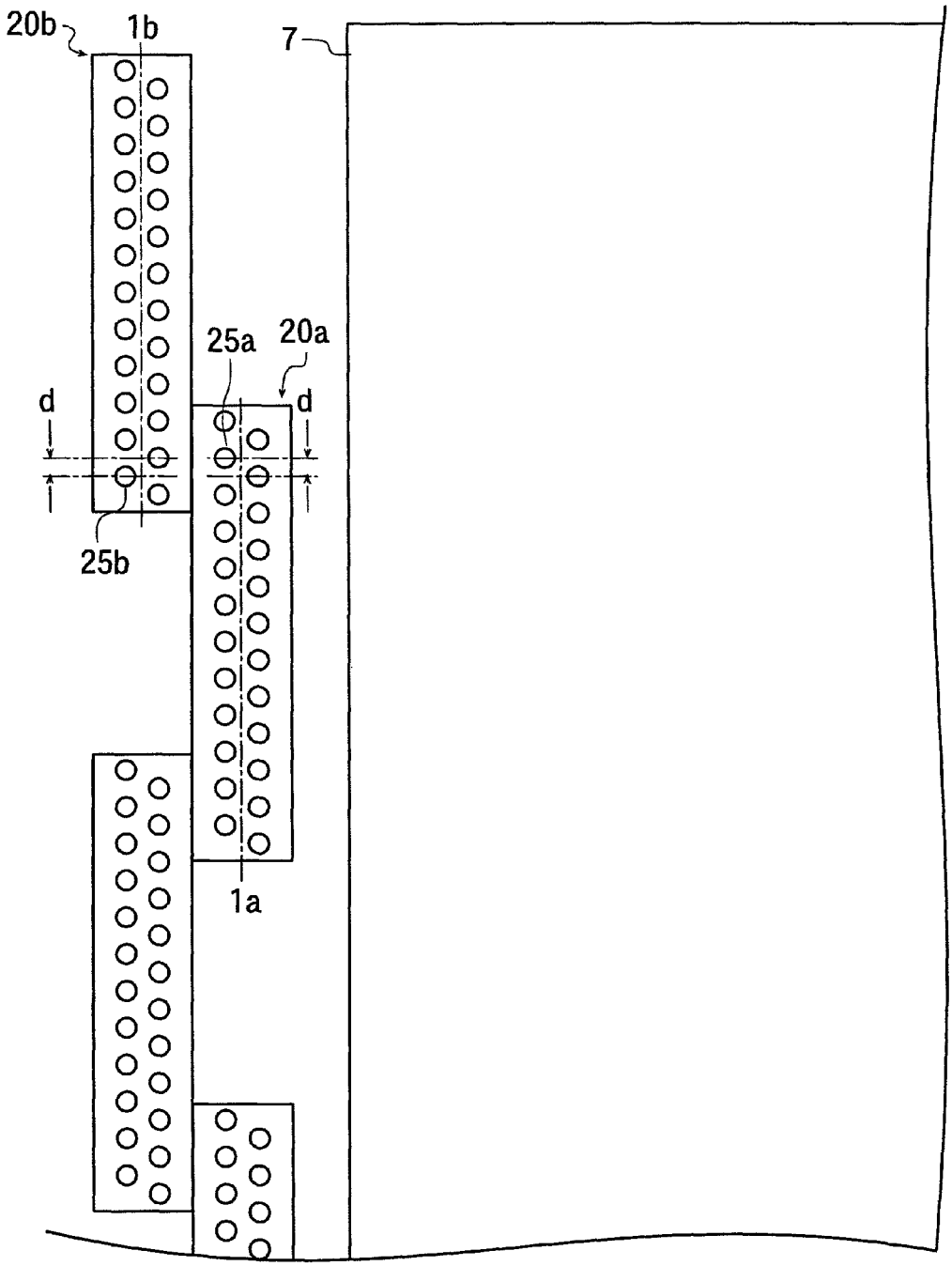
FIG. 2 is a plan view illustrating the mutual positional relationship between a first printing head and a second printing head.

FIG. 2 is a plan view for explaining the mutual positional relationship between the first and the second printing heads 20*a*, 20*b*. The first and second printing heads 20*a*, 20*b* respectively have a plurality of discharge holes 25*a*, 25*b*.

The first and second printing heads 20*a*, 20*b* have elongated shapes. When the discharge holes 25*a* of the first printing head 20*a* are referred to as a set of the first discharge holes and the discharge hole 25*b* of the second printing head 20*b* are referred to as a set of the second discharge holes, the first and second discharge holes are disposed in a single row or multiple rows along the longitudinal direction of the first and second printing heads 20*a*, 20*b*, respectively.

The longitudinal directions of the first and second printing heads 20*a*, 20*b* are set in parallel; thus, a row of the first discharge holes 25*a*, too, is in parallel to a row of the second discharge holes 25*b*.

In FIG. 2, reference numerals 1*a*, 1*b* denote straight lines in parallel to the directions along which the first and second discharge holes 25*a*, 25*b* are disposed.

In this embodiment, the first and second discharge holes 25*a*, 25*b* are disposed zigzag in two rows. In case where the first and second discharge holes 25*a*, 25*b* are respectively disposed in a plurality of rows, when the first and second discharge holes 25*a*, 25*b* disposed in the respective rows are moved in a direction vertical to the direction in which the first or second discharge holes 25*a*, 25*b* of the respective rows are disposed, the discharge liquid can be discharged to its discharging positions disposed at an equal interval d along one and the same straight line, as discussed later. The interval between the discharging positions on which the discharge liquid lands through the first discharge holes 25*a* is equal to that between the discharging positions on which the discharge liquid can be landed through the second discharge holes 25*b*.

The moving arm 12 is configured to move horizontally in a direction vertical to the directions in which the first and second discharge holes 25*a*, 25*b* are disposed.

In this printer 1, the first and second printing heads 20*a*, 20*b* are disposed forward and rearward of the moving direction, and they are disposed with their end portions overlapped so that they move along the same moving paths.

When the printing head on the forward side of the moving direction is referred to as the first printing head 20*a*, and printing head on the backward side of the moving direction is referred to as the second printing head 20*b*, in the portion where the first and second printing heads 20*a*, 20*b* are disposed, overlapped forward and rearward of the moving direction, one of the second discharge holes 25*b* are configured to move relative to each of the first discharge holes 25*a* along the moving path of a plurality of the first discharge holes 25*a* (10% or more, or 10 or more of the total first discharge holes 25*a*).

The first and second printing heads 20*a*, 20*b* are connected to a control unit 15 and a tank 16 such that the discharge liquid fed from the tank 16 can be discharged only through the desired first or second discharge holes 25*a*, 25*b* of a plurality of the first and second discharge holes 25*a*, 25*b*.

The positions of the first discharge hole 25*a* and the second discharge hole 25*b* moving along the same moving path are preliminarily known. For the first and second discharge holes 25*a*, 25*b* which are to move along the same moving path, the discharge liquid can be discharged through both of the discharge holes 25*a*, 25*b* toward the landing positions located under the moving path.

When the discharge liquid discharged through the first discharge hole 25*a* is referred to as a first discharge liquid and the discharge liquid discharged through the second discharge hole 26*b* is referred to as a second discharge liquid, the first and second discharge liquids have the same components and the same composition, but may differ in the amounts.

The first or second discharge holes 25*a*, 25*b* are disposed side by side in the other portions of the first and second printing heads 20*a*, 20*b*, so that when the first and second printing heads 20*a*, 20*b* are moved by the movable arm 12, only the first discharge liquids land on the landing positions located under the moving paths through which only the first discharging holes 25*a* pass, whereas only the second discharge liquids land on the landing positions located under the moving path through which only the second discharge holes 25*b* pass.

On a surface of a substrate, when an area where only the first discharge liquids land is referred to as a first area, and an area where only second discharge liquids land is referred to as a second area, a coated film is formed in the first area through the spreading of the first discharge liquids that bring the liquids into contact with one another, whereas a coated film is formed in the second area through the spreading of the second discharge liquids.

Figure 3:
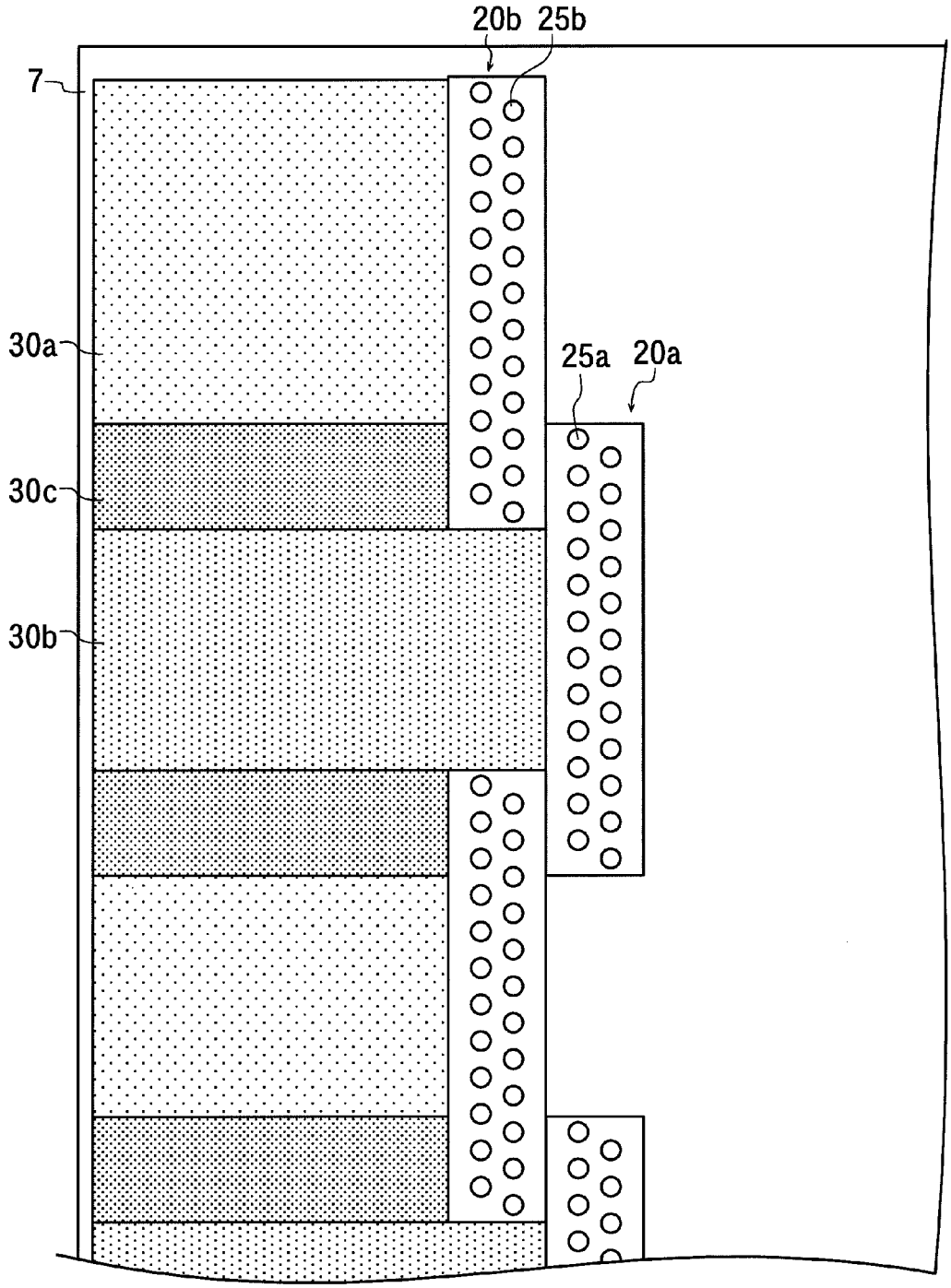
FIG. 3 is a plan view illustrating a midway state during a process to form a coated film.

In FIG. 3, reference numerals 30*a*, 30*b* denote the coated films formed in the first and second areas, respectively.

The first discharge liquid and the second discharge liquid can be set such that either one or both of them lands, or none of them lands, on a portion where the first and second discharge holes 25*a*, 25*b* move along the same moving path.

In this embodiment, both the first and second discharge liquids are controlled as to not land upon the same landing position in an overlapped state. On the landing positions under the moving path through which both the first and second discharge holes 25*a*, 25*b* pass, the first and second discharge liquids are controlled such that either one of them lands or none of them lands.

When an area through which both the first and second discharge holes 25*a*, 25*b* pass is referred to as a third area, the landing portions on which the first discharge liquids land and the landing portions on which the second discharge liquids land are present in a mixed state in the third area. A reference numeral 30*c* of the same figure denotes a coated film formed on the third area. The amount of the first discharge liquid and the amount of the second discharge liquid are adjusted as equal as possible, but they cannot be made completely identical, and a slight difference occurs in the liquid amount.

The landing positions on which the first or second discharge liquids land may be preliminarily set on a surface of a substrate 7. The landing positions are set at positions in a matrix fashion; in this embodiment, the intervals in the direction in which the first and second discharge holes 25*a*, 25*b* are disposed are equal to the interval d which is a equally-spaced interval among the discharge holes, and the interval of the first and second discharge holes 25*a*, 25*b* in the moving direction is set constant, although it can also be arbitrarily set.

Therefore, the density of the landing positions is constant, the coated film 30*a* of a first film thickness is formed in the first area according to the liquid amount of the first discharge liquids, and the coated film 30*b* of a second film thickness is formed in the second area according to the liquid amount of the second discharge liquids.

When either one of the first and second discharge liquids land on the landing positions in the third area, the average film thickness of the coated film 30*c* to be formed is a third film thickness, intermediate between the first and second film thicknesses. Since the differences in film thickness among the adjacent coated films 30*a* to 30*c* may be reduced, streaks can be eliminated.

In an embodiment of the present invention, as explained above, the landing positions on which the first and second discharge liquids are present in the mixed state in the landing positions arrayed in a line in a direction vertical to the direction in which the substrate and the first and second discharge holes 25*a*, 25*b* move relative to each other. Thereby, no streak extending along the relative moving direction appears.

Further, according to an embodiment, in the landing positions positioned in the third area, the landing positions on which the first and second discharge liquids land are mixed in the landing positions arrayed in line in a direction parallel to the relative moving direction of the substrate and the first and second discharge holes 25*a*, 25*b*.

By this, the landing positions on which the first discharge liquids land and the landing positions on which the second discharge liquids land are more uniformly distributed on the surface of the substrate 7 in the third area. As a result, a distance, which is consecutively disposed, between the landing positions on which the first discharge liquids land and the landing positions on which the second discharge liquids land, is shortened, so that it becomes more difficult to observe the streaks.

In order to make such a uniform distribution, only one condition has to be arbitrarily selected for each of the landing positions positioned in the third area from two possible conditions: a first condition to make only the first discharge liquid land; and a second condition to make only the second discharge liquid land. The discharge liquid may be discharged under the selected condition.

A third condition to not land any of the discharge liquids can be added besides the first and second conditions; in such a case, one condition can be arbitrarily selected from the three conditions including the first to third conditions, and the discharge liquid is discharged according to the selected condition.

This selection can be performed according to random numbers. For example, it is possible to have the landing positions located in the third area numbered beforehand; random numbers of natural numbers may be generated by using a computer; the generated random numbers may be associated with the landing positions in the order of the allotted numbers; the landing positions associated with even random numbers may be set to the first condition, and the landing positions associated with odd random numbers may be set to the second condition (in the case of two conditions).

In the case of three conditions, for example, the related random numbers are divided by 3, the landing position which leaves a remainder of zero can be set to the first condition, the landing position which leaves a remainder of 1 can be set to the second condition, and the landing positions which leaves a remainder of 2 can be set to the third condition.

However, when the landing positions are set to three conditions, in order to make the thickness of the thin film formed in the third area intermediate between the thickness of the coated film formed in the first area and the thickness of the coated film formed in the second area, the number of the positions to be landed on which one of the first and second discharge liquids that is greater than the other in discharge amount lands is increased, in accordance with the number of the positions that are set not to be landed by any discharge liquids.

As explained above, the condition is selected by using the random number sequence; then, the coated films 30*a* to 30*c* are formed, and the surface is observed. When a streak is spotted, the random number is discarded, and other random numbers may be generated and associated with the landing positions.

Figure 4:
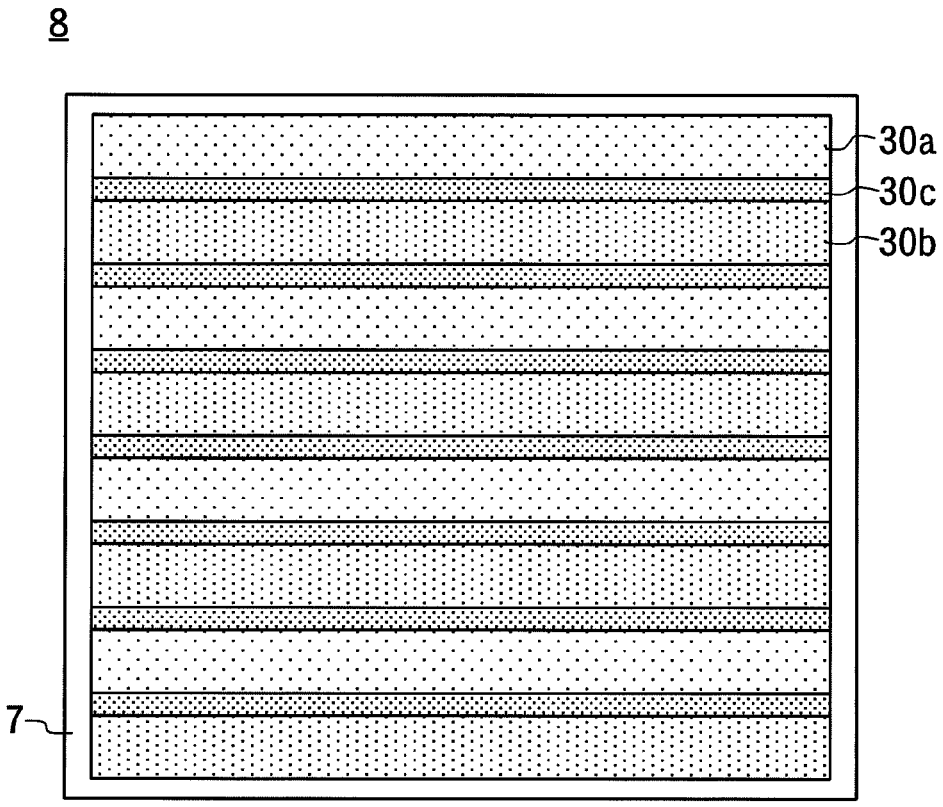
FIG. 4 is a plan view of a substrate on which coated films are formed.

In FIG. 4, a reference numeral 8 denotes a substrate on which the coated films 30*a* to 30*c* are formed by the above-explained procedure. When random numbers having caused no streaks to be observed are obtained, the random numbers are memorized in the control unit 15.

The substrate 8 with the coated films 30*a* to 30*c* formed thereon is carried off the top side of the table 11; then, an unprocessed substrate 7 is placed; the same random numbers are made associated with the same landing positions; and a coated film 30 can be formed by landing the discharge liquid on each landing position under a condition corresponding to its random number from the two or three conditions.

After the coated films 30*a* to 30*c* are formed, the coated films 30*a* to 30*c* may be cured by heating, either on the table 11, or in another heating unit after the substrate 8 with the coated films 30*a* to 30*c* formed thereon is carried into.

Figure 5:
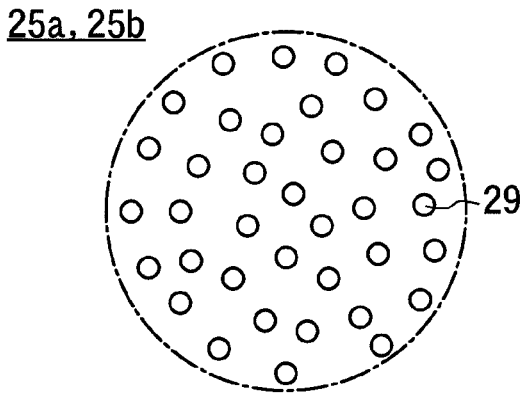
FIG. 5 is an enlarged plan view of first/second discharge holes.
Figure 6:
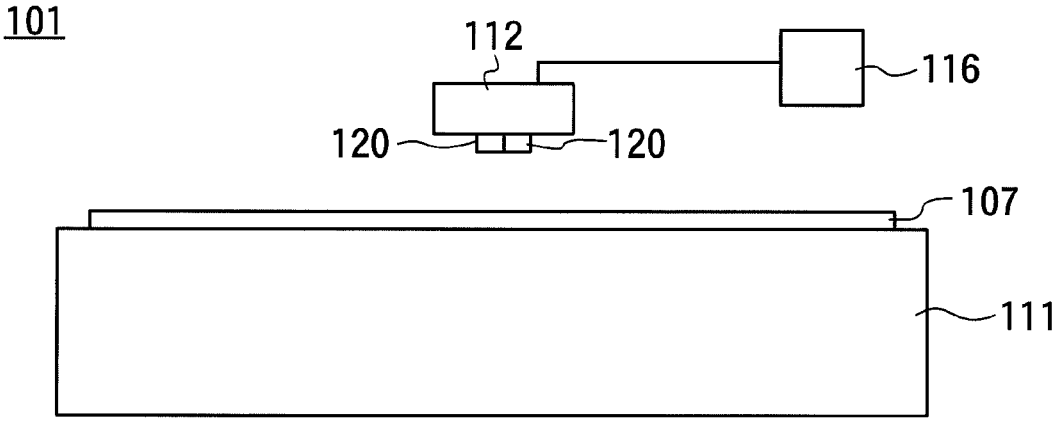
FIG. 6 is a schematic diagram illustrating a side view of a printing apparatus used in a conventional technique.
Figure 7:
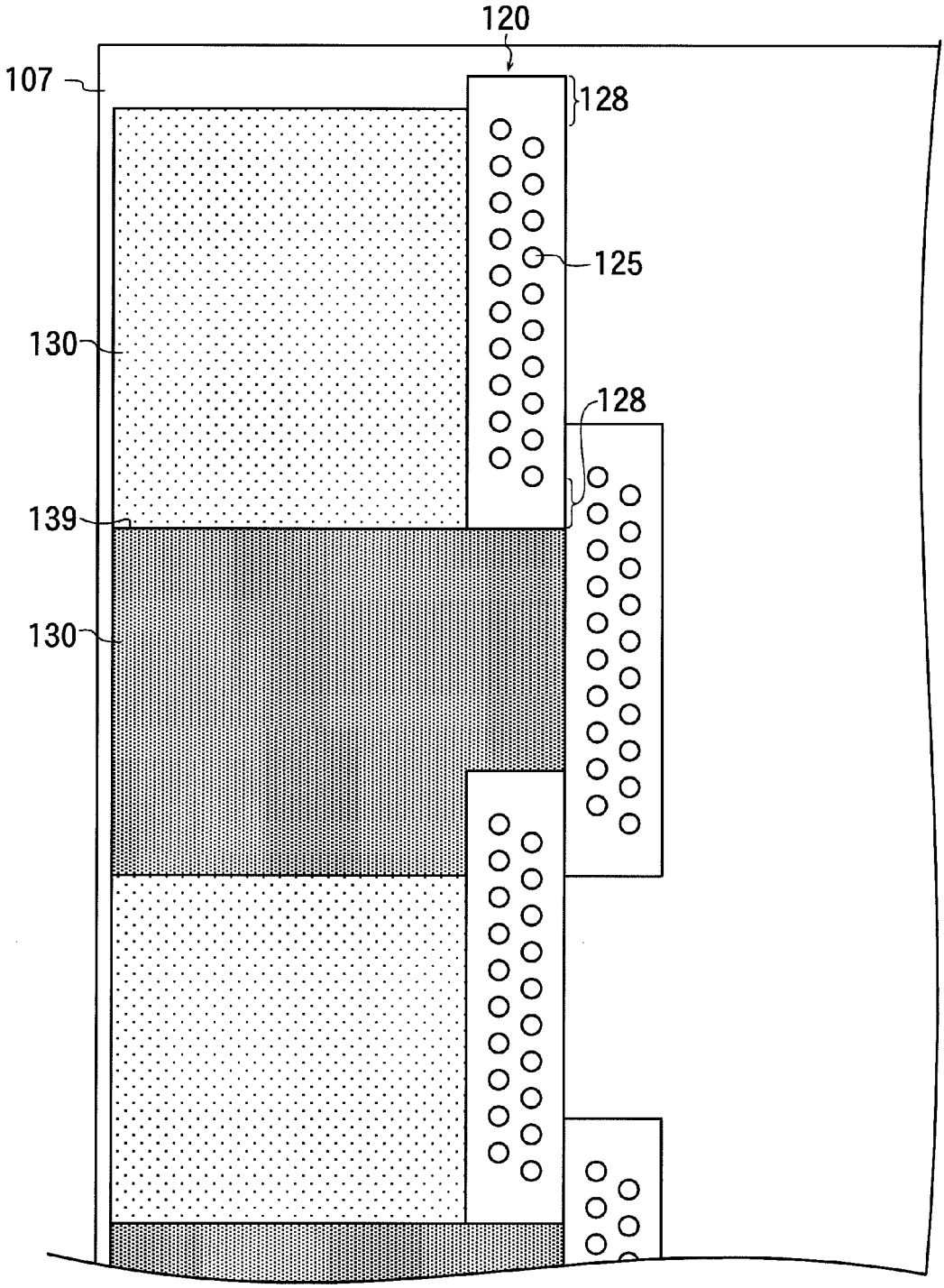
FIG. 7 is a plan view illustrating a midway state during a process to form the coated film according to a conventional technique.

Although the first and second discharge holes 25*a*, 25*b* are not particularly limited, each of the first and second discharge holes 25*a*, 25*b* in this embodiment is formed by the same number of numerous minute holes 29 gathered (FIG. 5), so that the discharge liquids are discharged through the respective minute holes 29.

In this embodiment, the first and second printing heads 20*a*, 20*b* and the substrate 7 are moved relatively, by the movable arm 12 moving the first and second printing heads 20*a*, 20*b* in a state such that the substrate 7 is at rest. Meanwhile, the relative movement may be performed by the substrate 7 moving in a state such that the first and second printing heads 20*a*, 20*b* are at rest. Further, the relative movement may be performed by the first and second printing heads 20*a*, 20*b* and the substrate 7 both moving.

What is claimed is:

1. A method for forming a coated film on a surface of the substrate by performing a relative movement between a substrate and a first printing head having a plurality of first discharge holes which are disposed along an identical first direction, and a second printing head having a plurality of second discharge holes which are disposed along an identical second direction, discharging a first discharge liquid from a first discharge hole, discharging a second discharge liquid from a first discharge hole and so as to land the first or the second discharge liquid on predetermined landing positions on the surface of the substrate, the method comprising steps of:

making the first printing head and the second printing head face in a manner such that the first direction and the second direction become parallel, the first direction and the second direction cross a direction of the relative movement, and the second discharge holes disposed at the edge of the second printing head move along a moving path where at least one of the first discharge holes disposed at the edge of the first printing head moves along;

disposing one of either the first printing head or the second printing head in front of the other to the direction of the relative movement;

wherein the landing positions include a first landing position located on a first moving path where only the first discharge holes pass above, a second landing position located on a second moving path where only the second discharge holes pass above, and a third landing position located on a third moving path where both the first discharge holes and the second discharge holes pass above, wherein a plurality of the third landing positions is disposed in at least one row in the direction perpendicular to the direction of the relative movement, making the first discharge liquid land on the first landing positions;

making the second discharge liquid land on the second landing positions; and making the first discharge liquid, the second discharge liquid or neither the first discharge liquid nor the second discharge liquid land on the third landing position disposed in one row, according to one landing condition selected by a random number from landing conditions including a first condition of which only the first discharge liquid lands, a second condition of which only the second discharge liquid lands, and a third condition of which neither the first discharge liquid nor the second discharge liquid lands.

2. The method for forming the coated film as set forth in claim 1, wherein the third landing positions are disposed in one row in the direction parallel to the direction of the relative movement, the method further comprising the steps of:

making the first discharge liquid, the second discharge liquid, or neither the first discharge liquid nor the second discharge liquid land on the third landing positions disposed in one row in the direction parallel to the direction of the relative movement, according to one landing condition selected from landing conditions including the first condition of which only the first discharge liquid lands, the second condition of which only the second discharge liquid lands, and the third condition of which neither the first discharge liquid nor the second discharge liquid lands.

3. The method for forming the coated film as set forth in claim 1, further comprising the steps of:

making both the first discharge liquid and the second discharge liquid not land on same landing position among the first landing positions, the second landing positions, and the third landing positions.

4. The method for forming the coated film as set forth in claim 1, further comprising the steps of:

forming a third film thickness of a third coated film formed on the third moving path to be a thickness between a first film thickness of a first coated film formed on the first moving path and a second film thickness of a second coated film formed on the second moving path.

5. The method for forming the coated film as set forth in claim 1, further comprising the steps of:

increasing a number of the landing positions on which a discharge liquid having larger discharging amount between the first discharge liquid and the second discharge liquid is made to land in accordance with the number of landing positions on which neither the first discharge liquid nor the second discharge liquid is made to land.

6. The method for forming coated film as set forth in claim 5, further comprising the step of:

storing the selected condition of every landing position, and making the first discharge liquid, the second discharge liquid or neither the first discharge liquid nor the second discharge liquid land on the third landing positions by selecting the same condition on the third landing positions which are on a different substrate and on the same position of the substrate.

7. A method for forming a coated film on a surface of the substrate by performing a relative movement between a substrate and a first printing head having a plurality of first discharge holes which are disposed along an identical first direction, and a second printing head having a plurality of second discharge holes which are disposed along an identical second direction, discharging a first discharge liquid from a first discharge hole, discharging a second discharge liquid from a second discharge hole and so as to land the first or the second discharge liquid on predetermined landing positions on the surface of the substrate;

the method comprising steps of:

making the first printing head and the second printing head face in a manner such that the first direction and the second direction become parallel, the first direction and the second direction cross a direction of the relative movement, and the second discharge holes disposed at the edge of the second printing head move along a moving path where at least one of the first discharge holes disposed at the edge of the first printing head moves along;

disposing one of either the first printing head or the second printing head in front of the other to the direction of the relative movement;

wherein the landing positions includes a first landing position located on a first moving path where only the first discharge holes pass above, a second landing position located on a second moving path where only the second discharge holes pass above, and a third landing position located on a third moving path where both the first discharge holes and the second discharge holes pass above, wherein a plurality of the third landing positions is disposed in at least one row in the direction parallel to the direction of the relative movement, making the first discharge liquid land on the first landing positions;

making the second discharge liquid land on the second landing positions; and making the first discharge liquid, or the second discharge liquid, or neither the first discharge liquid nor the second discharge liquid land on the third landing position disposed in one row, according to one landing condition selected by a random number from landing conditions including a first condition of which only the first discharge liquid lands, a second condition of which only the second discharge liquid lands, and a third condition of which neither the first discharge liquid nor the second discharge liquid lands.

* * * * *